US005261252A

United States Patent [19]

Peruch

[11] Patent Number: 5,261,252

[45] Date of Patent: Nov. 16, 1993

[54] NOISE REDUCTION SYSTEMS FOR A REFRIGERATED CENTRIFUGE INSTRUMENT

[75] Inventor: Angelo Peruch, Sandy Hook, Conn.

[73] Assignee: E. I. Du Pont de Nemours and Company, Wilmington, Del.

[21] Appl. No.: 958,995

[22] Filed: Oct. 9, 1992

[51] Int. Cl.[5] ..... F25D 17/00

[52] U.S. Cl. ..... 494/14; 62/181; 62/231

[58] Field of Search ..... 62/181, 231; 494/14

[56] References Cited

U.S. PATENT DOCUMENTS 3,040,543 6/1962 Atchison ..... 62/181

4,941,325 7/1990 Nuding ..... 62/181

FOREIGN PATENT DOCUMENTS 2-115643 4/1990 Japan ..... 62/231

*Primary Examiner*—William E. Wayner

[57] ABSTRACT

The noise emission from the centrifuge refrigeration system, and in particular, from the condenser fan therein, are minimized by monitoring the time duration during which the refrigeration compressor is asserted and, in accordance with the time duration of compressor assertion, controlling the speed of rotation of the condenser fan.

2 Claims, 3 Drawing Sheets

NOISE REDUCTION SYSTEMS FOR A REFRIGERATED CENTRIFUGE INSTRUMENT

BACKGROUND OF THE INVENTION

1. Field of the Invention

The present invention relates to a refrigerated centrifuge instrument and, in particular, to a refrigerated centrifuged instrument having a system for reducing the noise level associated with the operation of the centrifuge refrigeration system.

2. Description of the Prior Art

A centrifuge instrument is a apparatus adapted to expose a sample of a liquid carried within a rotating element, known as a rotor, to a centrifugal force field. FIG. 1 illustrates a highly stylized representation of a centrifuge instrument generally indicated by the reference character 10.

The centrifuge 10 includes a framework, schematically indicated by the reference character 12, that supports a bowl 14. Access to the interior of the bowl 14 is afforded through a lid 16. Sealed integrity between the bowl 14 and the door 16 is maintained by a seal 18 disposed on the periphery of the upper edge of the bowl 14.

A drive motor 22 is supported by the framework 12 beneath the bowl 14. A shaft 24 extends from the motor 22 into the interior of the bowl 14 through the opening 26. A rotor mounting element, or spud, 28 is disposed at the upper end of the shaft 24. The mounting element 28 supports a centrifuge rotor 30 thereon.

In some instances it may be necessary to refrigerate the interior of the bowl 14. To this end a refrigeration system generally indicated by the reference character 32 is provided. The refrigeration system 32 includes the series connection of an expansion valve 34, an evaporator coil 36, a compressor 38, and a condenser 40. The evaporator coil 36 is disposed in a heat transfer relationship with the exterior of the bowl 14. The condenser 40 has an associated fan 42 that is driven by a motor 44. The system 32 may include other elements, such as a filter/dryer and an expansion valve bulb with capillary tubing coil, as will be appreciated by those skilled in the art. These elements are omitted from FIG. 1 for clarity of illustration.

The temperature of the bowl 14 is monitored by a sensor 46 which provides a signal representative thereof over a line 48 to a controller 50, typically a microprocessor-based implementation. The controller 50 is connected to the drive motor 22 over a line 52, to the compressor 38 over a line 54, and to the condenser fan motor 44 over a line 56.

In response to a user-initiated start request the controller 50 verifies that no system faults are present and outputs a drive enable signal on the line 52 to assert the drive motor 22. The user also, in the typical case, requests a chamber temperature at which the centrifugation run will be performed.

Based upon the ambient temperature of the air in the bowl 14, as measured by the sensor 46, the controller 50 provides a control signal over the line 54 to assert the operation of the compressor 38, thereby to cause refrigerant to be circulated through the closed loop refrigeration system 32. In addition, a command is output from the controller 50 over the line 56 to assert the motor 44 for the fan 42, thereby to cause airflow over the condenser 40.

During periods when the instrument is not actually operating to spin a sample the air temperature within the bowl 14 is nevertheless monitored and maintained to some predetermined level in anticipation of a refrigerated run. This this period is usually termed "standby" mode. When a requirement for a lower bowl temperature is made by a user the ambient temperature of the bowl is drawn down from the standby level.

In the refrigerated instruments manufactured by the Medical Products Department of E. I. du Pont de Nemours and Company and sold as the "RC-2B" instrument and as the "RC-5B" instrument, whenever the motor 22 is asserted by the controller 50, the controller 50 simultaneously outputs a signal on the line 56 to assert the motor 44 for the fan 42. The compressor 38 is asserted as needed to hold the chamber temperature (as measured by the sensor 46) to the user-requested temperature.

It has been noticed, however, that the operation of the condenser fan 42 and its drive motor 44 are often a source of considerable noise, particularly during the standby mode. To control the noise emission caused by these elements it is also a known practice in the art to provide a thermostat 60 that monitors the temperature of the refrigerant through the condenser. Based upon this measurement a fan controller 62, typically a variable resistor arrangement, modifies the drive current applied to the fan motor over a line 64. The refrigerated instrument manufactured Andreas Hettich Company, Tuttlingen, Germany, and sold as the "Omnispin" exemplifies such a refrigeration noise control arrangement.

In view of the foregoing it is believed advantageous to provide a noise control system that minimizes the noise level associated with the assertion of the condenser fan.

SUMMARY OF THE INVENTION

The present invention relates to a refrigerated centrifuge instrument having a chamber and a refrigeration system for cooling the chamber. The refrigeration system includes an evaporator coil surrounding the chamber, a compressor which, when asserted, circulates refrigerant through the evaporator coil, a condenser for removing heat from the refrigerant, and a fan for passing a cooling medium over the condenser, the fan being operable at a first, lower, and a second, higher speed. Each speed having a predetermined noise level associated therewith, with the lower fan rotational speed causing a concomitantly lower noise level.

A first embodiment of the present invention finds utility with a centrifuge instrument in which the condenser fan motor is asserted simultaneously with each assertion of the centrifuge drive. In accordance with this embodiment of the invention, upon the assertion of the drive the fan motor is asserted for rotation at the first rotational speed. Means is provided for monitoring the time duration during which the compressor is asserted. Means is also provided that respond to the compressor monitoring means for asserting the fan for rotation at the second, higher, rotational speed when the time duration of compressor assertion exceeds a predetermined time threshold.

In accordance with a second embodiment of the present invention the means responsive to the compressor monitoring means asserts the fan at either the the first or the second rotational speed selected in accordance with the time duration of compressor operation. When compressor operation reaches a first time threshold, the fan is asserted at the first rotational speed. When the time duration of compressor assertion exceeds a second predetermined time threshold, the fan is rotated at the second rotational speed.

BRIEF DESCRIPTION OF THE DRAWINGS

The invention will be more fully understood from the following detailed description thereof taken in connection with the accompanying drawings, which form a part of this application and in which.

DETAILED DESCRIPTION OF THE INVENTION

Figure 1:
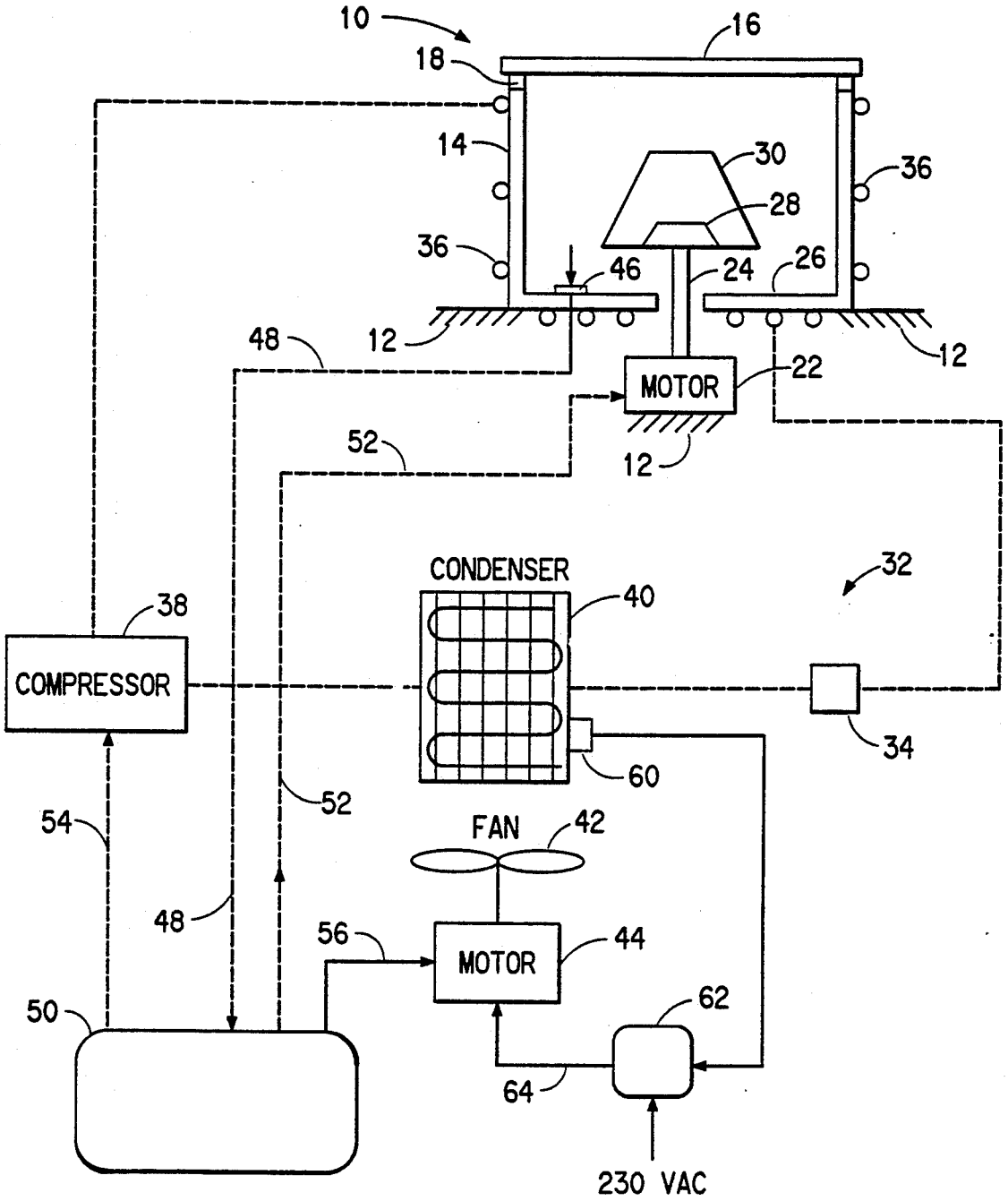
FIG. 1 (PRIOR ART)
FIG. 1 is a stylized pictorial and schematic representation of a refrigerated centrifuge instrument of the prior art.

Throughout the following detailed description similar reference numerals refer to similar elements in all figures of the drawings.

Figure 2:
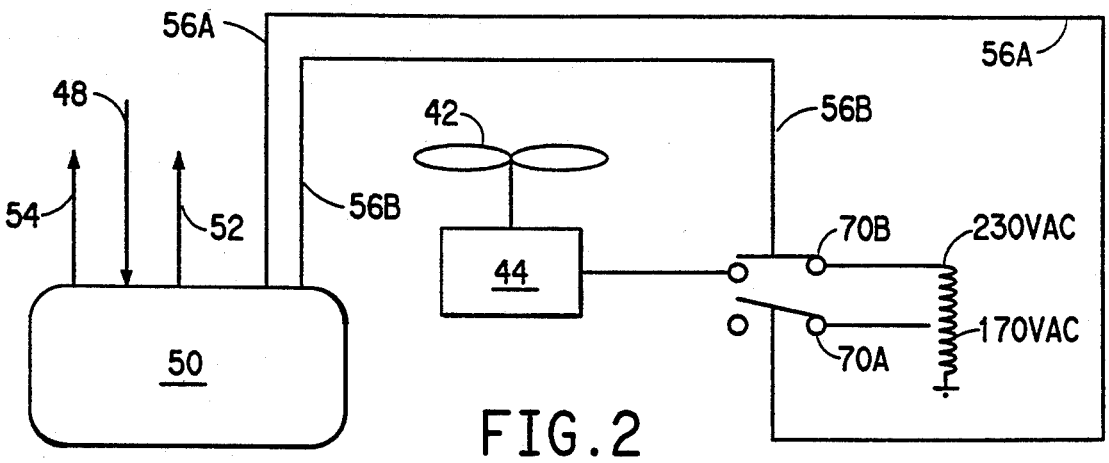
FIG. 2 is a schematic diagram representation of the improvement to the refrigerated centrifuge instrument in accordance with the present invention, the Figure showing only the additional interrelationships between the compressor, and fan motor.

With reference to FIG. 2 shown is an improved refrigeration system for a refrigerated centrifuge instrument in accordance with either embodiment of the present invention whereby noise emission from the operation of the fan is minimized. It is noted that only that portion of the refrigeration system of FIG. 1 that is modified by the present invention is illustrated in FIG. 2.

In accordance with this invention the thermostat 60 and the controller 62 are removed, and a pair of relay switches 70A, 70B are connected between the fan motor 44 and its ac source. The relay switch 70A is controlled by the controller 50 by a signal output on a line 56A, while the relay switch 70B is controlled by the controller 50 by a signal output on a line 56B. The fan motor 44 is therefore operable at a first, lower, speed when only the switch 70A is asserted, and a second, higher, speed, when only the switch 70B is asserted. Each fan motor speed has a predetermined noise level associated therewith. The noise level accompanying the lower fan speed is less than the noise level that accompanies the higher fan speed.

Figure 3:
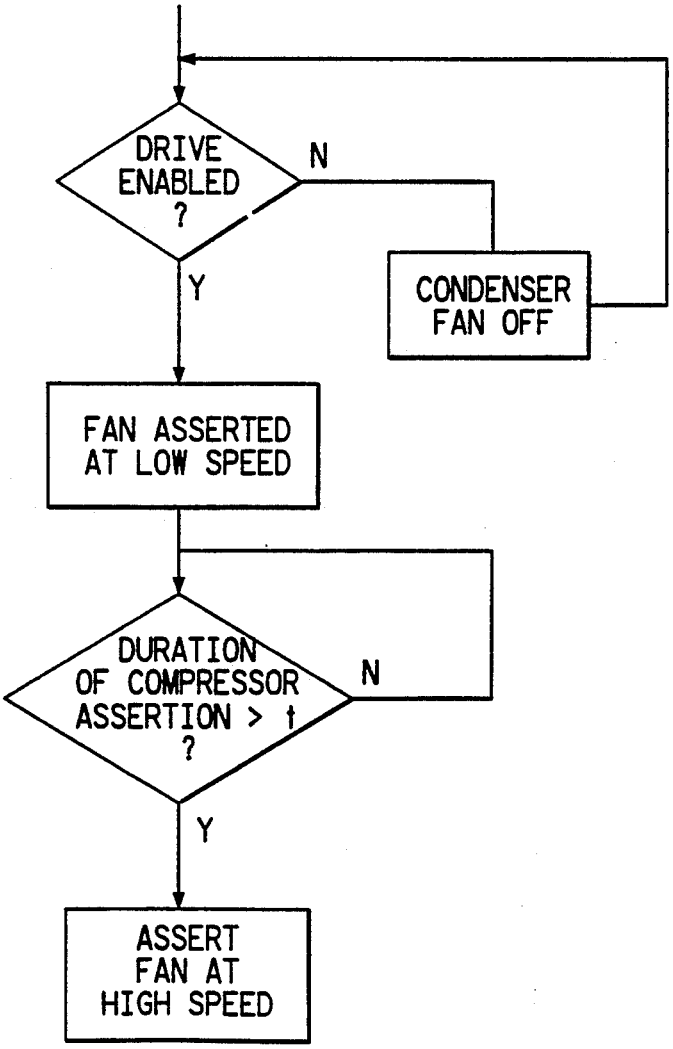
FIG. 3 is a flow diagram for a microprocessor-based implementation of a fan control system in accordance with a first embodiment of the present invention.
Figure 4:
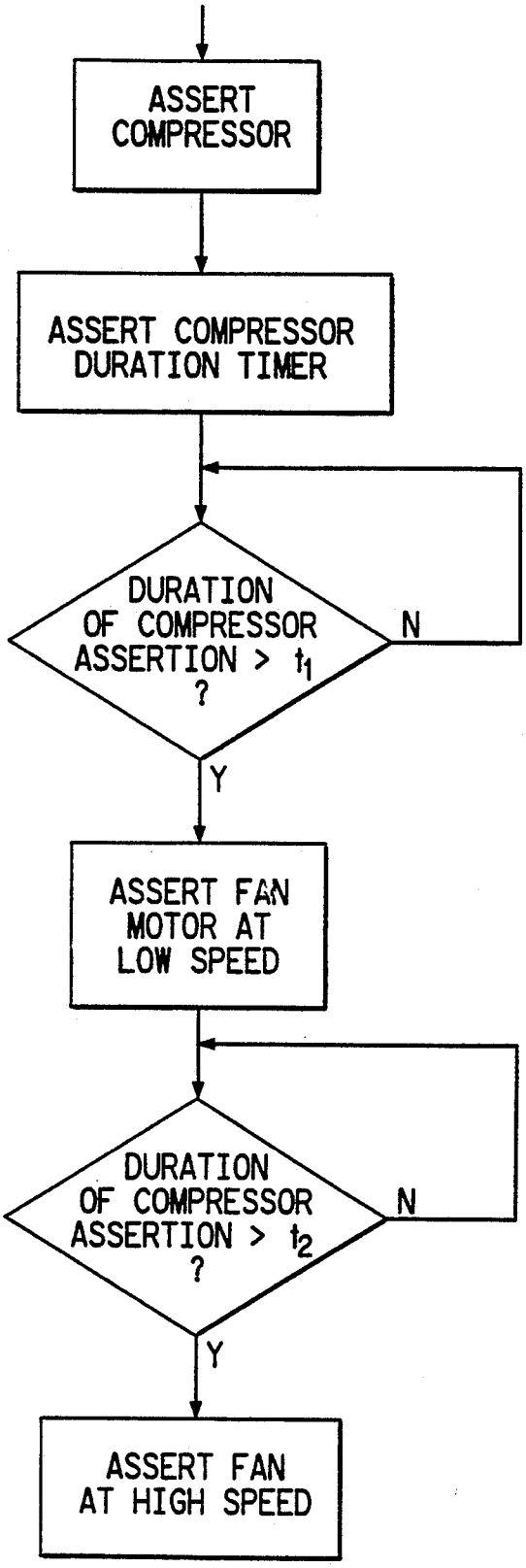
FIG. 4 is a flow diagram for a microprocessor-based implementation of a fan control system in accordance with a second embodiment of the present invention.

Since the controller 50 is most preferably realized as microprocessor-based implementation the operation of the both embodiments of the present invention will be quickly understood with reference to the respective flow diagram of the controller program for fan control purposes shown in FIGS. 3 and 4. In both embodiments of the invention, the duration of compressor assertion is monitored and is used to control the fan speed. Accordingly, noise emissions from the fan are minimized.

In the normal condition the switches 70A, 70B are both open, disconnecting the fan motor 44 from its source. In accordance with a first embodiment of the present invention the condenser fan motor 44 remains unasserted until a drive enable signal is generated by the controller 50 and output therefrom on the line 52 to the motor 22. The generation of a drive enable signal is based upon a variety of considerations, mostly safety or performance related, as will be appreciated by those skilled in the art. Neither of the switches 70A, 70B is actuated prior to the assertion of the drive enable signal. Upon the generation of a drive enable signal, the controller 50 asserts the switch 70A over the line 56A, thus applying the lower voltage value to the motor 44. The fan 42 is driven at its first, lower, speed, thereby producing the lower noise level.

The compressor 38 is asserted by the controller 50 on an as-needed basis. In some implementations, it may be desired to limit operation of the compressor to limited time duration bursts (e.g., on the order of eight seconds) as long as the speed of the drive motor 22 is some predetermined fraction of some predetermined rated speed. Once the speed threshold is met, the compressor 38 may be asserted to meet the refrigeration requirements of the instrument. Of course, other compressor assertion schemes may be used.

However, in accordance with this invention, whenever the compressor 38 is asserted by the controller 50 over the line 62 a timer is initiated which begins timing the duration of the compressor operation. The controller 50 may be appropriately programmed to implement this compressor timing function. When the time of compressor assertion exceeds a predetermined time threshold (for example, thirty seconds) the controller 50 opens the switch 70A and actuates the switch 70B over the line 56B, thus applying the higher voltage value to the motor 44 and thereby driving the fan 42 at the second, higher, speed.

It may thus be appreciated that in accordance with this first embodiment of the invention the condenser fan motor 44 is asserted at the lower speed based upon the generation of a drive enable signal to the centrifuge motor 22. Once the drive enable signal is generated the assertion of the fan motor 44 at the second, higher, speed is based upon the time duration of the compressor operation, as monitored by the controller 50.

The operation of the second embodiment of the present invention will be quickly understood with reference to the flow diagram of the controller program for fan control purposes shown in FIG. 4. Again, in the normal condition the switches 70A, 70B are both open, disconnecting the fan motor 44 from its source.

The compressor 38 is asserted by the controller 50 (over the line 54) in response to the signal on the line 48 (from the sensor 46, FIG. 1) and the time duration of compressor operation is monitored. When the time duration of compressor operation exceeds a first predetermined time threshold $t_1$ the controller 50 asserts the switch 70A over the line 56A, thus applying the lower voltage value to the motor 44 and thereby driving the fan 42 at the first, lower, speed (and producing the lower noise level). Any convenient threshold $t_1$ may be selected, with a typical value being ten seconds.

The controller 50 continues to monitor the time of assertion of the compressor 38. When the time duration of compressor operation exceeds a second predetermined time threshold $t_2$ the controller 50 opens the switch 70A and asserts the switch 70B over the line 56B, thus applying the higher voltage value to the motor 44. The fan is thereby driven at its second, higher, speed. Again, any convenient threshold $t_2$ may be selected, with a typical value being thirty seconds.

Those skilled in the art, having the teachings of the present invention as hereinabove set forth, may effect numerous modifications thereto. It should be understood that these and such modifications lie within the comtemplation of the present invention, as defined by the appended claims.

What is claimed is:

1. In a centrifuge instrument having a chamber, a shaft projecting into the chamber, a drive motor for rotating the shaft, and a refrigeration system for cooling the chamber, the refrigeration system including an evaporator coil surrounding the chamber, a compressor which, when asserted, circulates refrigerant through the evaporator coil, a condenser for removing heat from the refrigerant, and a fan for passing a cooling medium over the condenser, the fan being operable at a first, lower, and a second, higher speed, each speed having a predetermined noise level associated therewith, a lower noise level being associated with the lower speed, the fan being asserted for operation at the first lower speed upon the assertion of the drive motor for the shaft, the improvement comprising:

means for monitoring the time duration during which the compressor is asserted; and means responsive to the compressor monitoring means for increasing the rotational speed of the fan in accordance with the time duration of compressor assertion.

2. In a centrifuge instrument having a chamber, a refrigeration system for cooling the chamber, the refrigeration system including an evaporator coil surrounding the chamber, a compressor which, when asserted, circulates refrigerant through the evaporator coil, a condenser for removing heat from the refrigerant, and a fan for passing a cooling medium over the condenser, the fan being operable at a first, lower, and a second, higher speed, each speed having a predetermined noise level associated therewith, a lower noise level being associated with the lower speed, the improvement comprising:

means for monitoring the time duration during which the compressor is asserted; and means responsive to the compressor monitoring means for asserting the fan or for rotating the same at either the first or the second rotational speed in accordance with the time duration of compressor assertion.

* * * * *